US007080896B2

(12) United States Patent
Bell et al.

(10) Patent No.: US 7,080,896 B2
(45) Date of Patent: Jul. 25, 2006

(54) MICRO-FLUID EJECTION DEVICE HAVING HIGH RESISTANCE HEATER FILM

(75) Inventors: Byron V. Bell, Paris, KY (US); Robert W. Cornell, Lexington, KY (US); Yimin Guan, Lexington, KY (US); George K. Parish, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 276 days.

(21) Appl. No.: 10/760,726

(22) Filed: Jan. 20, 2004

(65) Prior Publication Data

US 2005/0157089 A1 Jul. 21, 2005

(51) Int. Cl.
*B41J 2/05* (2006.01)

(52) U.S. Cl. ..... 347/62

(58) Field of Classification Search ..... 347/62–64, 347/203–206

See application file for complete search history.

(56) References Cited

U.S. PATENT DOCUMENTS 3,775,278 A 11/1973 Hensler et al
4,042,479 A 8/1977 yamazaki et al
4,535,343 A 8/1985 Wright et al
4,649,070 A 3/1987 Kondo et al
4,801,067 A 1/1989 Kondo et al
4,809,428 A * 3/1989 Aden et al. ..... 29/611
4,862,197 A 8/1989 Stoffel
5,231,306 A 7/1993 Meikle et al
5,489,548 A 2/1996 Nishioka et al
5,504,041 A 4/1996 Summerfelt
5,554,564 A 9/1996 Nishioka et al
5,636,441 A 6/1997 Meyer et al
5,793,057 A 8/1998 Summerfelt
5,796,166 A 8/1998 Agnello et al
5,892,281 A 4/1999 Akram et al
5,962,911 A 10/1999 Manley
6,133,636 A 10/2000 Akram et al
6,239,492 B1 5/2001 Meikle et al
6,322,711 B1 11/2001 Chen
6,391,769 B1 5/2002 Lee et al
6,404,057 B1 6/2002 Akram et al
6,410,426 B1 6/2002 Xiing et al
6,432,818 B1 8/2002 Akram et al
6,432,820 B1 8/2002 Lee et al (Continued)

FOREIGN PATENT DOCUMENTS

CA 1128669 7/1982

(Continued)

*Primary Examiner*—An H. Do
(74) *Attorney, Agent, or Firm*—Lexmark, Nealy & Graham

(57) ABSTRACT

A semiconductor substrate for a micro-fluid ejection head. The substrate includes a plurality of fluid ejection actuators disposed on the substrate. Each of the fluid ejection actuators includes a thin heater stack comprising a thin film heater and one or more protective layers adjacent the heater. The thin film heater is made of a tantalum-aluminum-nitride thin film material having a nano-crystalline structure consisting essentially of AlN, TaN, and TaAl alloys, and has a sheet resistance ranging from about 30 to about 100 ohms per square. The thin film material contains from about 30 to about 70 atomic % tantalum, from about 10 to about 40 atomic % aluminum and from about 5 to about 30 atomic % nitrogen.

11 Claims, 5 Drawing Sheets

U.S. PATENT DOCUMENTS

| | | | | |
|---|---|---|---|---|
| 6,467,864 | B1 * | 10/2002 | Cornell | 347/14 |
| 6,500,724 | B1 | 12/2002 | Zurcher et al | |
| 6,513,913 | B1 * | 2/2003 | Schulte et al. | 347/63 |
| 6,527,813 | B1 | 3/2003 | Saito et al | |
| 6,545,339 | B1 | 4/2003 | Cabral, Jr. et al | |
| 6,583,052 | B1 | 6/2003 | Shin et al | |
| 2002/0100981 | A1 | 8/2002 | Akram et al. | |
| 2003/0017699 | A1 | 1/2003 | Zurcher et al | |

FOREIGN PATENT DOCUMENTS

| | | |
|---|---|---|
| JP | 54034097 | 3/1979 |
| JP | 57141949 | 9/1982 |
| JP | 60089567 | 10/1983 |
| JP | 60089568 | 5/1985 |
| JP | 11111919 | 4/1999 |
| RU | 2194335 | 12/2002 |

* cited by examiner

Fig. 1
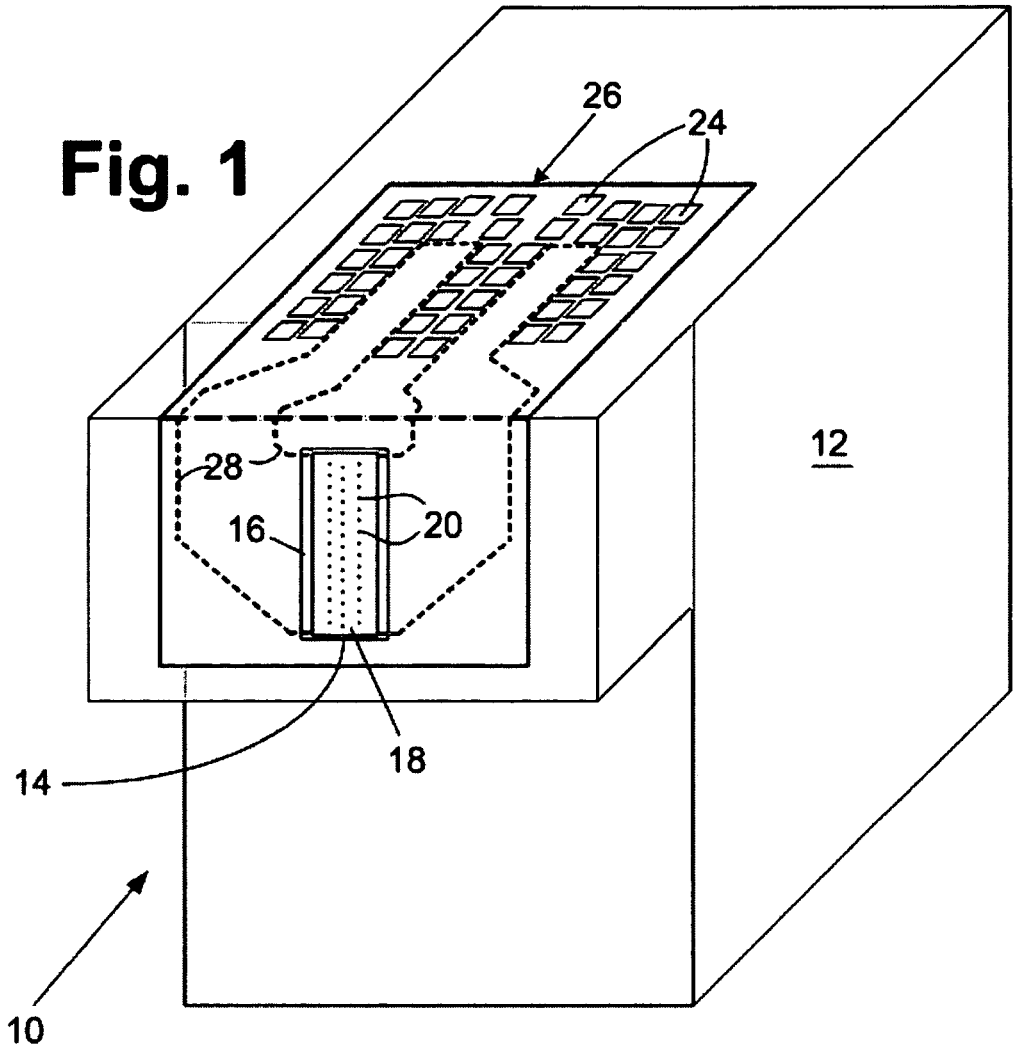
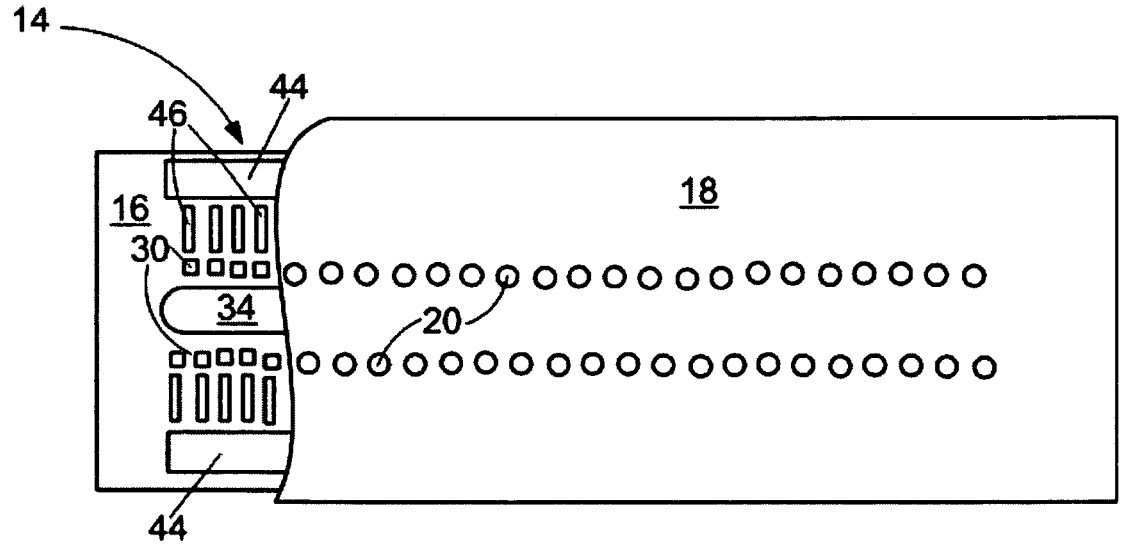
Fig. 4

MICRO-FLUID EJECTION DEVICE HAVING HIGH RESISTANCE HEATER FILM

FIELD OF THE INVENTION

The invention relates to micro-fluid ejection devices and in particular to ejection heads for ejection devices containing high resistance heater films.

BACKGROUND OF THE INVENTION

Micro-fluid ejection devices such as ink jet printers continue to experience wide acceptance as economical replacements for laser printers. Micro-fluid ejection devices also are finding wide application in other fields such as in the medical, chemical, and mechanical fields. As the capabilities of micro-fluid ejection devices are increased to provide higher ejection rates, the ejection heads, which are the primary components of micro-fluid devices, continue to evolve and become more complex. As the complexity of the ejection heads increases, so does the cost for producing ejection heads. Nevertheless, there continues to be a need for micro-fluid ejection devices having enhanced capabilities including increased quality and higher throughput rates. Competitive pressure on print quality and price promote a continued need to produce ejection heads with enhanced capabilities in a more economical manner.

SUMMARY OF THE INVENTION

With regard to the foregoing and other objects and advantages there is provided a semiconductor substrate for a micro-fluid ejection head. The substrate includes a plurality of fluid ejection actuators disposed on the substrate. Each of the fluid ejection actuators includes a thin heater stack comprising a thin film heater and one or more protective layers adjacent the heater. The thin film heater is made of a tantalum-aluminum-nitride thin film material having a nano-crystalline structure consisting essentially of AlN, TaN, and TaAl alloys, and has a sheet resistance ranging from about 30 to about 100 ohms per square. The thin film material contains from about 30 to about 70 atomic % tantalum, from about 10 to about 40 atomic % aluminum and from about 5 to about 30 atomic % nitrogen.

In another embodiment there is provided a process for making a fluid ejector head for a micro-fluid ejection device. The process includes the steps of providing a semiconductor substrate, and depositing a thin film resistive layer on the substrate to provide a plurality of thin film heaters. The thin film resistive layer is a tantalum-aluminum-nitride thin film material having a nano-crystalline structure of AlN, TaN, and TaAl alloys, and has a sheet resistance ranging from about 30 to about 100 ohms per square. The resistive layer contains from about 30 to about 70 atomic % tantalum, from about 10 to about 40 atomic % aluminum and from about 5 to about 30 atomic % nitrogen. A conductive layer is deposited on the thin film heaters, and is etched to define anode and cathode connections to the thin film heaters. One or more layers selected from a passivation layer, a dielectric, an adhesion layer, and a cavitation layer are deposited on the thin film heaters and conductive layer. A nozzle plate is attached to the semiconductor substrate to provide the fluid ejector head.

In yet another embodiment, there is provided a method for making a thin film resistor. The method includes providing a semiconductor substrate and heating the substrate to a temperature ranging from above about room temperature to about 350° C. A tantalum aluminum alloy target containing from about 50 to about 60 atomic % tantalum and from about 40 to about 50 atomic % aluminum is reactive sputtered onto the substrate. During the sputtering step, a flow of nitrogen gas and a flow of argon gas are provided wherein a flow rate ratio of nitrogen to argon ranges from about 0.1:1 to about 0.4:1. The sputtering step is terminated when the thin film resistor is deposited on the substrate with a thickness ranging from about 300 to about 3000 Angstroms. The thin film resistor is a TaAlN alloy containing from about 30 to about 70 atomic % tantalum, from about 10 to about 40 atomic % aluminum and from about 5 to about 30 atomic % nitrogen, and has a substantially uniform sheet resistance with respect to the substrate.

An advantage of certain embodiments of the invention can include providing improved micro-fluid ejection heads having thermal ejection heaters which require lower operating currents and can be operated at substantially higher frequencies while maintaining relatively constant resistances over the life of the heaters. The ejection heaters also have an increased resistance which can enable the resistors to be driven with smaller drive transistors, thereby potentially reducing the substrate area required for active devices to drive the heaters. A reduction in the area required for active devices to drive the heaters can enable the use of smaller substrate, thereby potentially reducing the cost of the devices. An advantage of the production methods for making the thin film resistors as described herein can include that the thin film heaters have a substantially uniform sheet resistance over the surface of a substrate on which they are deposited.

BRIEF DESCRIPTION OF THE DRAWINGS

Further advantages of the invention will become apparent by reference to the detailed description of exemplary embodiments when considered in conjunction with the following drawings illustrating one or more non-limiting aspects of the invention, wherein like reference characters designate like or similar elements throughout the several drawings as follows:

FIG. 1 is a micro-fluid ejection device cartridge, not to scale, containing a micro-fluid ejection head according to one embodiment of the invention;

FIG. 4 is a plan view not to scale of a typical layout on a substrate for a micro-fluid ejection head according to one embodiment of the invention;

DETAILED DESCRIPTION OF THE INVENTION

With reference to FIG. 1, a fluid cartridge 10 for a micro-fluid ejection device is illustrated. The cartridge 10 includes a cartridge body 12 for supplying a fluid to a fluid ejection head 14. The fluid may be contained in a storage area in the cartridge body 12 or may be supplied from a remote source to the cartridge body.

Figure 2:
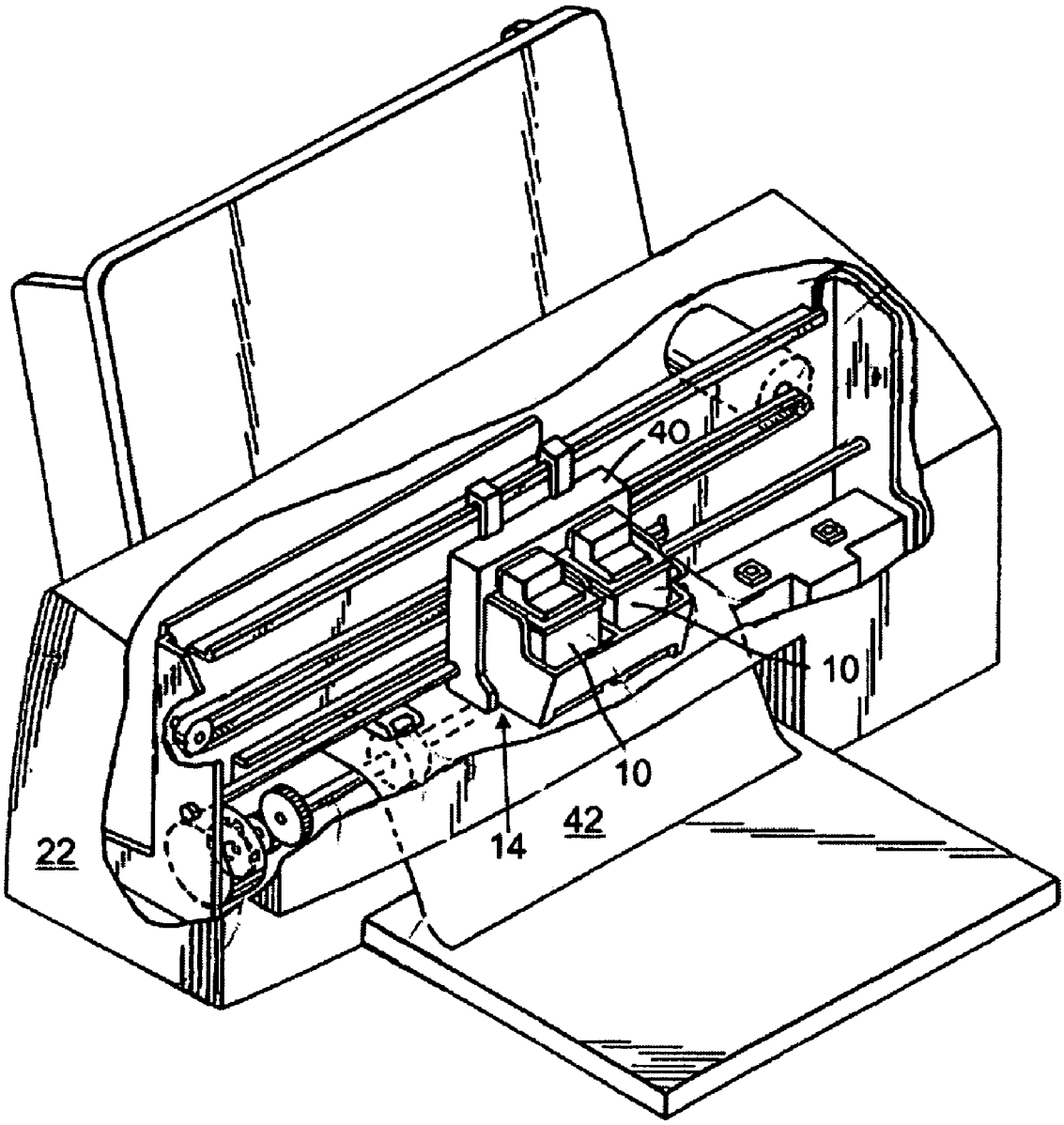
FIG. 2 is a perspective view of an ink jet printer and ink cartridge containing a micro-fluid ejection head according to one embodiment of the invention.

The fluid ejection head 14 includes a semiconductor substrate 16 and a nozzle plate 18 containing nozzle holes 20. In one embodiment of the present invention, it is preferred that the cartridge be removably attached to a micro-fluid ejection device such as an ink jet printer 22 (FIG. 2). Accordingly, electrical contacts 24 are provided on a flexible circuit 26 for electrical connection to the micro-fluid ejection device. The flexible circuit 26 includes electrical traces 28 that are connected to the substrate 16 of the fluid ejection head 14.

Figure 3:
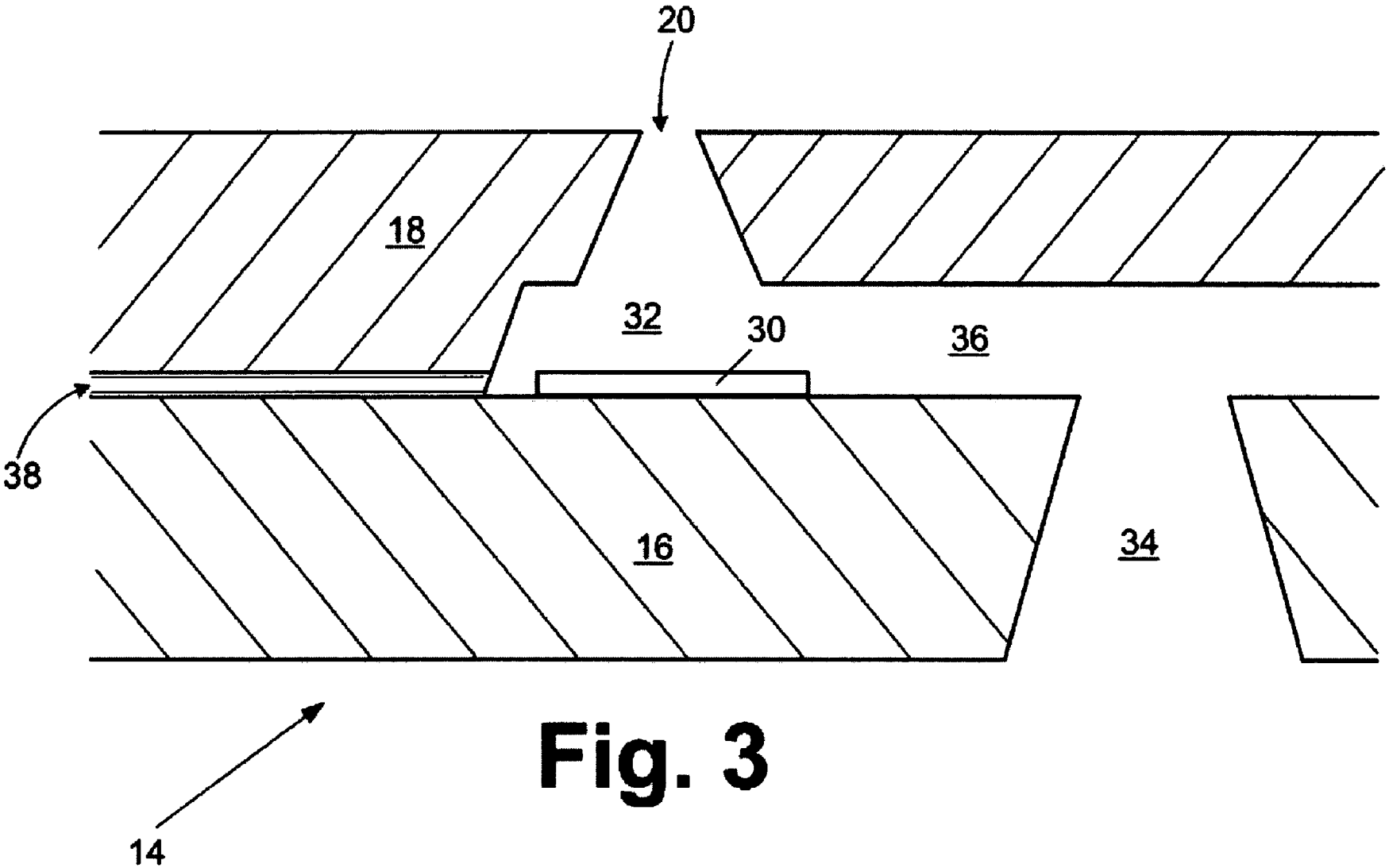
FIG. 3 is a cross-sectional view, not to scale of a portion of a micro-fluid ejection head according to one embodiment of the invention.

An enlarged cross-sectional view, not to scale, of a portion of the fluid ejection head 14 is illustrated in FIG. 3. In one embodiment, the fluid ejection head 14 preferably contains a thermal heating element 30 as a fluid ejection actuator for heating the fluid in a fluid chamber 32 formed in the nozzle plate 18 between the substrate 16 and a nozzle hole 20. The thermal heating elements 30 are thin film heater resistors which, in an exemplary embodiment, are comprised of an alloy of tantalum, aluminum, nitrogen, as described in more detail below.

Fluid is provided to the fluid chamber 32 through an opening or slot 34 in the substrate 16 and through a fluid channel 36 connecting the slot 34 with the fluid chamber 32. The nozzle plate 18 can be adhesively attached to the substrate 16, such as by adhesive layer 38. As depicted in FIG. 3, the flow features including the fluid chamber 32 and fluid channel 36 can be formed in the nozzle plate 18. However, the flow features may be provided in a separate thick film layer, and a nozzle plate containing only nozzle holes may be attached to the thick film layer. In an exemplary embodiment, the fluid ejection head 14 is a thermal or piezoelectric ink jet printhead. However, the invention is not intended to be limited to ink jet printheads as other fluids, other than ink, may be ejected with a micro-fluid ejection device according to the invention.

Referring again to FIG. 2, the fluid ejection device can be an ink jet printer 22. The printer 22 includes a carriage 40 for holding one or more cartridges 10 and for moving the cartridges 10 over a media 42 such as paper depositing a fluid from the cartridges 10 on the media 42. As set forth above, the contacts 24 on the cartridge mate with contacts on the carriage 40 for providing electrical connection between the printer 22 and the cartridge 10. Microcontrollers in the printer 22 control the movement of the carriage 40 across the media 42 and convert analog and/or digital inputs from an external device such as a computer for controlling the operation of the printer 22. Ejection of fluid from the fluid ejection head 14 is controlled by a logic circuit on the fluid ejection head 14 in conjunction with the controller in the printer 22.

A plan view, not to scale of a fluid ejection head 14 is shown in FIG. 4. The fluid ejection head 14 includes a semiconductor substrate 16 and a nozzle plate 18 attached to the substrate 16. A layout of device areas of the semiconductor substrate 16 is shown providing exemplary locations for logic circuitry 44, driver transistors 46, and heater resistors 30. As shown in FIG. 4, the substrate 16 includes a single slot 34 for providing fluid such as ink to the heater resistors 30 that are disposed on both sides of the slot 34. However, the invention is not limited to a substrate 16 having a single slot 34 or to fluid ejection actuators such as heater resistors 30 disposed on both sides of the slot 34. For example, other substrates according to the invention may include multiple slots with fluid ejection actuators disposed on one or both sides of the slots. The substrate may also not include slots 34, whereby fluid flows around the edges of the substrate 16 to the actuators. Rather than a single slot 34, the substrate 16 may include multiples or openings, one each for one or more actuator devices. The nozzle plate 18, such as one made of an ink resistant material such as polyimide, is attached to the substrate 16.

Figure 5:
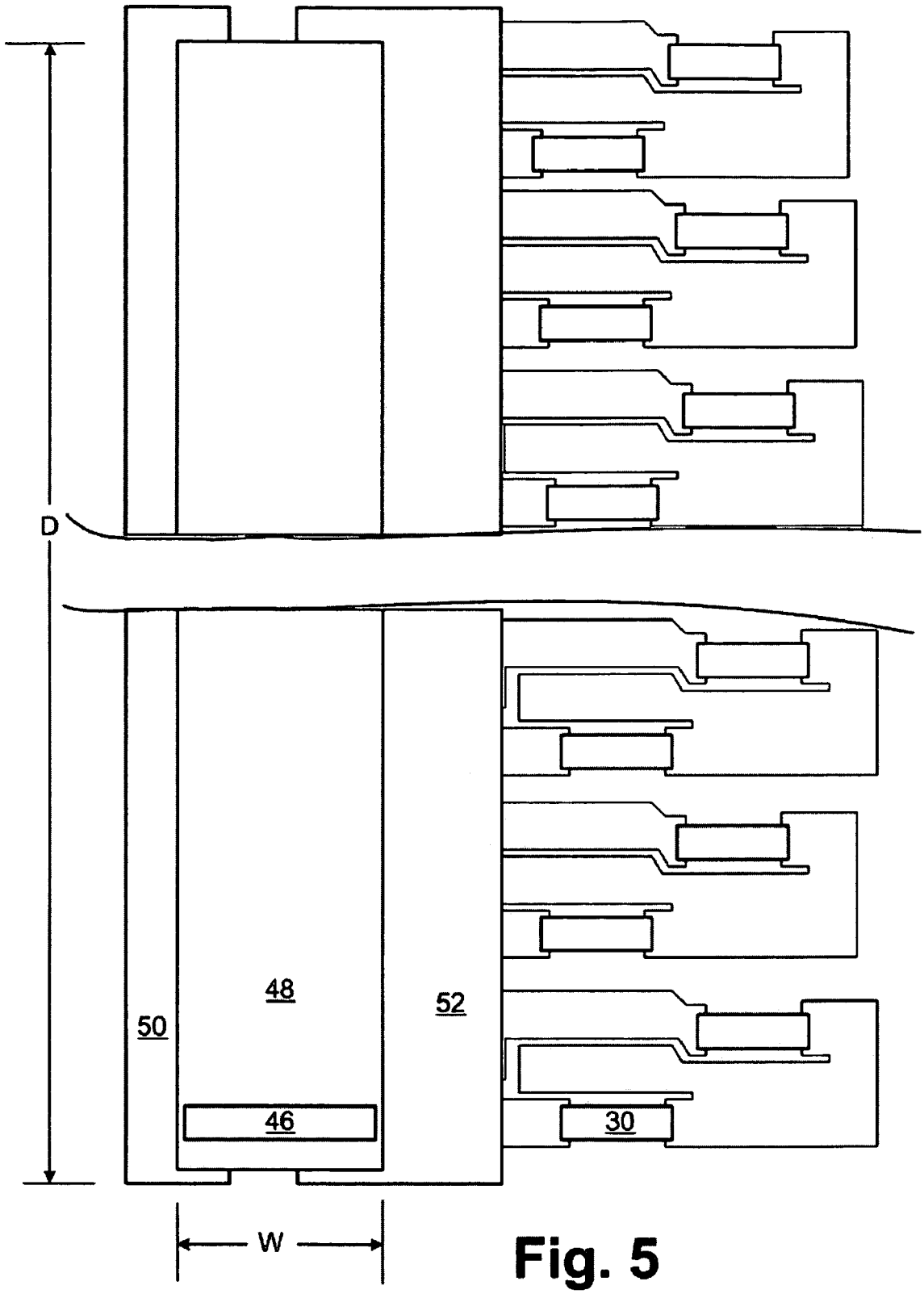
FIG. 5 is a cross-sectional view of a heater stack area of a micro-fluid ejection head according to one embodiment of the invention.

An active area 48 of the substrate 16 required for the driver transistors 46 is illustrated in detail in a plan view of the active area 48 in FIG. 5. This figure represents a portion of a typical heater array and active area 48. A ground bus 50 and a power bus 52 are provided to provide power to the devices in the active area 46 and to the heater resistors 30.

In order to reduce the size of the substrate 16 required for the micro-fluid ejection head 14, the driver transistor 46 active area width indicated by (W) is reduced. In an exemplary embodiment, the active area 48 of the substrate 16 has a width dimension W ranging from about 100 to about 400 microns and an overall length dimension D ranging from about 6,300 microns to about 26,000 microns. The driver transistors 46 are provided at a pitch P ranging from about 10 microns to about 84 microns.

In one exemplary embodiment, the area of a single driver transistor 46 in the semiconductor substrate 16 has an active area width (W) ranging from about 100 to less than about 400 microns, and an active area of, for example, less than about 15,000 $\mu m^2$. The smaller active area 46 can be achieved by use of driver transistors 46 having gates lengths and channel lengths ranging from about 0.8 to less than about 3 microns.

However, the resistance of the driver transistor 46 is proportional to its width W. The use of smaller driver transistors 46 increases the resistance of the driver transistor 46. Thus, in order to maintain a constant ratio between the heater resistance and the driver transistor resistance, the resistance of the heater 30 can be increased proportionately. A benefit of a higher resistance heater 30 can include that the heater requires less driving current. In combination with other features of the heater 30, one embodiment of the invention provides an ejection head 14 having higher efficiency and a head capable of higher frequency operation.

There are several ways to provide a higher resistance heater 30. One approach is to use a higher aspect ratio heater, that is, a heater having a length significantly greater than its width. However, such high aspect ratio design tends to trap air in the fluid chamber 32. Another approach to providing a high resistance heater 30 is to provide a heater made from a thin film having a higher sheet resistance. One such material is TaN. However, relatively thin TaN has inadequate aluminum barrier characteristics thereby making it less suitable than other materials for use in micro-fluid ejection devices. Aluminum barrier characteristics can be particularly important when the resistive layer is extended over and deposited in a contact area for an adjacent transistor device. Without a protective layer, for example TiW, in the contact area, the thin film TaN is insufficient to prevent diffusion between aluminum deposited as the contact metal and the underlying silicon substrate.

An exemplary heater, according to one embodiment of the invention, is a thin film heater 30 made of an alloy of tantalum, aluminum, and nitrogen. In contrast to the thin film TaN heater described above, a thin film heater 30 made according to such an embodiment of the invention can also provide a suitable barrier layer in an adjacent transistor contact area without the use of an intermediate barrier layer between the aluminum contact and silicon substrate, as well as provide a higher resistance heater 30.

The thin film heater 30 can be provided by sputtering a tantalum/aluminum alloy target onto a substrate 16 in the presence of nitrogen and argon gas. In one embodiment, the tantalum/aluminum alloy target preferably has a composition ranging from about 50 to about 60 atomic percent tantalum and from about 40 to about 50 atomic percent aluminum. In an exemplary embodiment, the resulting thin film heater 30 preferably has a composition ranging from about 30 to about 70 atomic percent tantalum, more preferably from about 50 to about 60 atomic percent tantalum, from about 10 to about 40 atomic percent aluminum, more preferably from about 20 to about 30 atomic percent aluminum, and from about 5 to about 30 atomic percent nitrogen, more preferably from about 10 to about 20 atomic percent nitrogen. The bulk resistivity of the thin film heaters 30 according to an exemplary embodiment preferably ranges from about 300 to about 1000 micro-ohms-cm.

In order to produce a TaAlN heater 30 having the characteristics described above, suitable sputtering conditions are desired. For example, in one embodiment, the substrate 16 can be heated to above room temperature, more preferably from about 100° to about 350° C. during the sputtering step. Also, the nitrogen to argon gas flow rate ratio, the sputtering power and the gas pressure are preferably within relatively narrow ranges. In one exemplary process, the nitrogen to argon flow rate ratio ranges from about 0.1:1 to about 0.4:1, the sputtering power ranges from about 40 to about 200 kilowatts/$m^2$ and the pressure ranges from about 1 to about 25 millitorrs. Suitable sputtering conditions for providing a TaAlN heaters 30 according to one embodiment of the invention are given in the following table.

| Run No. | Total Flow (sccm) | $N_2$ Flow (sccm) | Ar Flow (sccm) | $N_2$/Ar Ratio | Power (KW/$m^2$) | Pressure (millitorr) | Substrate Temperature (° C.) | Deposition Rate (Å/min) |
|---|---|---|---|---|---|---|---|---|
| 1 | 150 | 35 | 115 | 0.30 | 92 | 8.5 | 200 | — |
| 2 | 150 | 25 | 125 | 0.20 | 92 | 11.0 | 200 | 4937.4 |
| 3 | 140 | 25 | 115 | 0.22 | 92 | 3.0 | 300 | 5523.0 |
| 4 | 125 | 30 | 95 | 0.30 | 92 | 11.0 | 200 | — |
| 5 | 100 | 10 | 90 | 0.11 | 42 | 2.0 | 300 | 2415.6 |
| 6 | 100 | 25 | 75 | 0.33 | 141 | 2.0 | 300 | 7440.0 |
| 7 | 100 | 25 | 75 | 0.33 | 141 | 20.0 | 100 | 8007.6 |
| 8 | 125 | 20 | 105 | 0.19 | 141 | 11.0 | 200 | 7323.6 |
| 9 | 125 | 20 | 105 | 0.19 | 92 | 3.0 | 200 | 4999.8 |
| 10 | 150 | 25 | 125 | 0.20 | 92 | 11.0 | 200 | — |
| 11 | 125 | 30 | 95 | 0.32 | 92 | 11.0 | 200 | 5144.4 |

Heaters 30 made according to the foregoing process exhibit a relatively uniform sheet resistance over the surface area of the substrate 16 ranging from about 10 to about 100 ohms per square. The sheet resistance of the thin film heater 30 has a standard deviation over the entire substrate surface of less than about 2 percent, preferably less than about 1.5 percent. Such a uniform resistivity significantly improves the quality of ejection heads 14 containing the heaters 30. The heaters 30 made according to the foregoing process can tolerate high temperature stress up to about 800° C. with a resistance change of less than about 5 percent. The heaters 30 made according to such an embodiment of the invention can also tolerate high current stress. Also, unlike TaAlN resistors made by sputtering bulk tantalum and aluminum targets on room temperature substrates, such as described in U.S. Pat. No. 4,042,479 to Yamazaki et al., the thin film heaters 30 made according to such an embodiment of the invention may be characterized as having a substantially mono-crystalline structure consisting essentially of AlN, TaN, and TaAl alloys. By using TaAlN as the material for the heater resistor 30, the layer providing the heater resistor 30 may be extended to provide a metal barrier for contacts to adjacent transistor devices and may also be used as a fuse material on the substrate 16 for memory devices and other applications.

Figure 6:
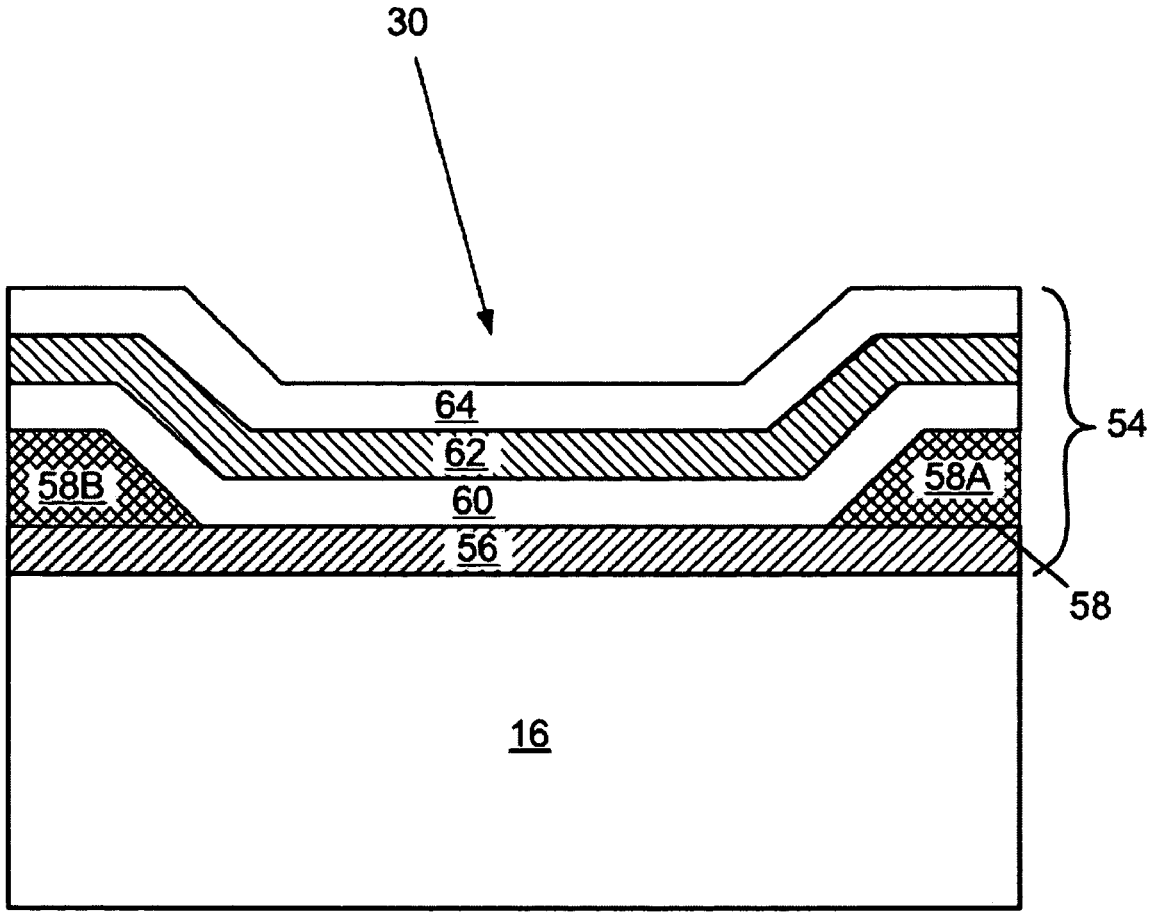
FIG. 6 is a plan view, not to scale of a portion of an active area of a micro-fluid ejection head according to one embodiment of the invention.

A more detailed illustration of a portion of an ejection head 14 showing an exemplary heater stack 54 including a heater 30 made according to the above described process is illustrated in FIG. 6. The heater stack 54 is provided on an insulated substrate 16. First layer 56 is the thin film resistor layer made of TaAlN which is deposited on the substrate 16 according to the process described above.

After depositing the thin film resistive layer 56, a conductive layer 58 made of a conductive metal such as gold, aluminum, copper, and the like is deposited on the thin film resistive layer 56. The conductive layer 58 may have any suitable thickness known to those skilled in the art, but, in an exemplary embodiment, preferably has a thickness ranging from about 0.4 to about 0.6 microns. After deposition of the conductive layer 58, the conductive layer is etched to provide anode 58A and cathode 58B contacts to the resistive layer 56 and to define the heater resistor 30 therebetween the anode and cathode 58A and 58B.

A passivation layer or dielectric layer 60 can then be deposited on the heater resistor 30 and anode and cathode 58A and 58B. The layer 60 may be selected from diamond like carbon, doped diamond like carbon, silicon oxide, silicon oxynitride, silicon nitride, silicon carbide, and a combination of silicon nitride and silicon carbide. In an exemplary embodiment, a particularly preferred layer 60 is diamond like carbon having a thickness ranging from about 1000 to about 8000 Angstroms.

When a diamond like carbon material is used as layer 60, an adhesion layer 62 can be deposited on layer 60. The adhesion layer 62 may be selected from silicon nitride, tantalum nitride, titanium nitride, tantalum oxide, and the like. In an exemplary embodiment, the thickness of the adhesion layer preferably ranges from about 300 to about 600 Angstroms.

After depositing the adhesion layer 62, in the case of the use of diamond like carbon as layer 60, a cavitation layer 64 can be deposited and etched to cover the heater resistor 30. An exemplary cavitation layer 64 is tantalum having a thickness ranging from about from about 1000 to about 6000 Angstroms.

It is desirable to keep the passivation or dielectric layer 60, optional adhesion layer 62, and cavitation layer 64 as thin as possible yet provide suitable protection for the heater resistor 30 from the corrosive and mechanical damage effects of the fluid being ejected. Thin layers 60, 62, and 64 can reduce the overall thickness dimension of the heater stack 54 and provide reduced power requirements and increased efficiency for the heater resistor 30.

Once the cavitation layer 64 is deposited, this layer 64 and the underlying layer or layers 60 and 62 may be patterned and etched to provide protection of the heater resistor 30. A second dielectric layer made of silicon dioxide can then be deposited over the heater stack 54 and other surfaces of the substrate to provide insulation between subsequent metal layers that are deposited on the substrate for contact to the heater drivers and other devices.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of exemplary embodiments only, not limiting thereto, and that the true spirit and scope of the present invention be determined by reference to the appended claims.

What is claimed is:

1. A substrate for a micro-fluid ejection head, the substrate comprising a plurality of fluid ejection actuators disposed on the substrate, each of the fluid ejection actuators including a thin heater stack comprising a thin film heater and one or more protective layers adjacent the heater, wherein the thin film heater is comprised of a tantalum-aluminum-nitride thin film material having a nano-crystalline structure consisting essentially of AlN, TaN, and TaAl alloys, and the thin film material having a sheet resistance ranging from about 30 to about 100 ohms per square, and containing from about 30 to about 70 atomic % tantalum, from about 10 to about 40 atomic % aluminum and from about 5 to about 30 atomic % nitrogen.

2. The substrate of claim 1 wherein the thin film heater comprises a thin film layer made by a process of reactive sputtering a tantalum-aluminum alloy target in a nitrogen containing atmosphere on a substrate heated to a temperature ranging from about 100° to about 350° C.

3. The substrate of claim 2 wherein at least one of the protective layers comprises a diamond-like-carbon material.

4. The substrate of claim 3 wherein the diamond-like-carbon layer has a thickness ranging from about 1000 to about 8000 Angstroms.

5. The substrate of claim 2 wherein the thin film heater has a thickness ranging from about 300 to about 3000 Angstroms.

6. The substrate of claim 3 further comprising a cavitation layer as an ink contact surface, wherein the cavitation layer has a thickness ranging from about 1000 to about 6000 Angstroms.

7. The substrate of claim 6 further comprising an adhesion layer disposed between the cavitation layer and the diamond-like-carbon layer, the adhesion layer having a thickness ranging from about 400 to about 600 Angstroms.

8. The substrate of claim 7 wherein the adhesion layer is comprised of a material selected from silicon nitride and tantalum nitride.

9. The substrate of claim 1 further comprising a plurality of drive transistors for driving the plurality of fluid ejection actuators, the drive transistors having an active area width ranging from about 100 to less than about 400 microns.

10. An ink jet printer containing the substrate of claim 1.

11. The ink jet printer of claim 10 wherein the micro-fluid ejection head contains a high density of thin film heaters ranging from about 6 to about 20 thin film heaters per square millimeter.

* * * * *